US006022570A

United States Patent [19]

Richmond

[11] Patent Number: 6,022,570

[45] Date of Patent: Feb. 8, 2000

[54] DUAL-COMPARTMENT COMMUNION CONTAINER

[76] Inventor: Lolita Richmond, 38130 Lakeshore Blvd., Willoughby, Ohio 44094

[21] Appl. No.: 09/053,472

[22] Filed: Apr. 1, 1998

Related U.S. Application Data

[63] Continuation-in-part of application No. 29/057,979, Aug. 5, 1996, Pat. No. Des. 395,125.

[51] Int. Cl.[7] ..... A21D 10/02; A45C 11/00; B65D 77/00

[52] U.S. Cl. ..... 426/120; 426/122; 426/123; 206/19; 206/217

[58] Field of Search ..... 426/120, 122, 426/112, 106, 123; 206/217, 19; D99/25; D7/511, 513

[56] References Cited

U.S. PATENT DOCUMENTS

| | | | |
|---|---|---|---|
| D. 291,659 | 9/1987 | Powell . | |
| D. 303,311 | 9/1989 | Vezirian . | |
| D. 304,514 | 11/1989 | Vezirian et al. . | |
| D. 335,382 | 5/1993 | O'Brien . | |
| 641,917 | 1/1900 | Young et al. . | |
| 2,794,545 | 6/1957 | Olson . | |
| 4,096,947 | 6/1978 | Morse . | |
| 4,324,338 | 4/1982 | Beall . | |
| 4,416,370 | 11/1983 | Beall . | |
| 4,703,849 | 11/1987 | Vezirian et al. . | |
| 4,923,702 | 5/1990 | Powell et al. . | |
| 5,029,700 | 7/1991 | Chen | 206/217 |
| 5,246,106 | 9/1993 | Johnson . | |
| 5,456,351 | 10/1995 | Johnson | 206/217 |
| 5,749,491 | 5/1998 | Wylder et al. | 220/719 |
| 5,775,570 | 7/1998 | Kim | 206/217 |

*Primary Examiner*—Anthony J. Weier
*Attorney, Agent, or Firm*—Howard M. Cohn

[57] ABSTRACT

A dual-compartment, disposable, sanitary, individual-serving comestibles package for purveying a pair of separate and dissimilar food items. A first compartment is formed by a cup which is closed off by a first, removable closure element. A second compartment is formed by a recess within a sidewall of the cup, and is closed off by a second closure element which is preferably only partially removable.

17 Claims, 3 Drawing Sheets

DUAL-COMPARTMENT COMMUNION CONTAINER

CROSS-REFERENCE TO RELATED APPLICATIONS

This application is a continuation-in-part of application 29/057,979 filed Aug. 5, 1996 and now U.S. Pat. No. D 395,125.

TECHNICAL FIELD OF THE INVENTION

The present invention relates to a package for containing, purveying and serving individual-size portions of edible (including drinkable) food items and, more particularly, to a package having two compartments for separately containing two separate food items, such as an individual serving of a liquid food item and an individual serving of solid food item.

BACKGROUND OF THE INVENTION

In religious ceremonies, such as Christian religious ceremonies, bread (and sometimes, other bread-like food items such as a wafer, a cracker and the like) plays a central role in the "communion" (or "sacrament") portion of the service where a bread-like (solid) food item and a liquid food item such as water, wine or juice is served, typically by a religious leader, to the communicants. As recorded in the New Testament, in the book of Matthew, Chapter 26, verses 26–28:

26. And as they were eating, Jesus took bread, and blessed it, and brake it, and gave it to the disciples, and said, Take, eat; this is my body.
27. And he took the cup, and gave thanks, and gave it to them, saying, Drink ye all of it;
28. For this is my blood of the new testament, which is shed for many for the remission of sins.

The number of congregants involved in a religious service can range from two to thousands or more. In some religious denominations, the two sacramental food items, bread and wine, are dispensed to individuals, typically by only one or a few religious leaders, to one congregant at a time as the congregants approach a designated location in the chapel (church). In other denominations, a tray or trays containing a plurality of servings of the sacramental food items may be passed among the congregants, whereupon they are served or serve themselves.

The present invention is directed to packaging for distribution, purveying, storing, serving and dispensing for consuming individual portions of communion elements (e.g., the sacramental food items of bread and wine).

The following U.S. patents, each of which is incorporated in its entirety herein, are representative of communion containers.

U.S. Pat. No. 4,703,849 (1987) discloses a vending package.

The package has dual compartments, a first compartment for a bread item and a second compartment for a liquid item, and is directed toward the packaging of communion elements for use in religious services. The package (10) is generally in the form of a cup. An outer wall (16) extends from a bottom element (18) to a top lip (12). A partition (20) extends across the cup between two points on the outer wall, and extends between the bottom element to the level of the top lip. The partition defines two chambers within the cup: a first chamber (30) for housing liquid; and a second chamber (32) for housing a solid. A cover (28) of a membranous sheet of thermoplastic or thermoplastic-coated paper extends across the opening of the cup and is sealed (e.g., heat-sealed) to the top lip. A pull tab (24) is formed on the periphery of the cover, as an aid in removing the cover.

U.S. Design Pat. No. 291,659 (1987) discloses a communion container which appears (there being no descriptive text in a design patent) to be in the form of a cup with a lid. And the lid appears to have a recess in a central portion thereof, which is closed off by a plastic sheet.

U.S. Design Pat. No. 303,311 (1989) discloses a communion cup bearing what appears to be a raised symbol of the cross on an exterior surface thereof. The cross-symbol appears to be strictly ornamental. No functionality of the cross symbol is suggested by this patent.

U.S. Design Pat. No. 304,514 (1989) discloses a communion cup which appears to have an outer annular open-ended chamber surrounding an inner pedestal having a shallow recess.

U.S. Design Pat. No. 335,382 (1993) discloses an individual holy communion packet which appears to be in the form of a cup having a first screw-on lid, and a second screw-on lid which screws onto the first screw-on lid.

U.S. Pat. No. 4,923,702 (1990) discloses a communion container for containing a portion of wine/grape juice and a portion of bread. A lid is secured about the open mouth of the cup to seal the portion of wine/grape juice within the cup. The bread portion is sealed within a receptacle which is attached to the cup atop the lid. A tab on the lid is positioned beneath the receptacle to prevent inadvertent removal of the lid until the receptacle is opened.

U.S. Pat. No. 5,246,106 (1993) discloses a compartmental communion container comprising a small open-top cup adapted for containing juice or wine and provided with a substantially flat upper edge or flange. The cup is closed by a two-part (two layer) lid within which communion bread in the form of an edible wafer is received. The top layer of the lid is first removed to access the wafer, and the lower part of the lid is later removed so that a juice or wine within the cup can be taken.

U.S. Pat. No. 4,096,947 (1978) discloses a nesting cup construction. The cups, in nested condition, each define a recess capable of retaining a dehydrated comestible above a lower wall thereof.

U.S. Pat. No. 4,324,338 (1982) discloses a compartmented container suited for use in conjunction with administering the sacramental elements during a communion service. A first compartment is substantially cup-like in a form to hold liquid therein. A second compartment is located below the first compartment for holding a communion wafer. See also U.S. Pat. No. 4,416,370 (1983).

The present invention is designed to improve the method of serving and distributing sacramental food items ("Communion") in religious services, retreats and visiting the sick and/or shut-in.

With the rise of communicable diseases and problems with handling food products in un-sanitized areas, the Communion Container of the present invention will be welcomed, as it is pre-filled, disposable, and sanitary, and will take less time from religious services without the time-consuming preparation of preparing for Communion Service. The dual-compartment Communion container of the present invention will fit in the standard Communion serving tray.

BRIEF DESCRIPTION (SUMMARY) OF THE INVENTION

It is an object of the invention to provide a package which will incorporate the advantages of a sanitary packaging of individual, disposable Communion food items for mass distribution of ceremonial food (e.g., bread/wafer/cracker) and a liquid beverage, such as at religious ceremonies, in churches, on retreats and visitation of the sick and shut in—to wit, unleavened bread and grape (or other) juice.

According to the invention, a Communion Container comprises a cup having a base portion, and a sidewall extending upward from the base portion and forming an opening at the top of the cup. The sidewall has an inner surface and an outer surface. The cup is intended to contain a liquid (beverage), is sized to hold an individual portion (e.g., 1–10 fluid ounces, preferably 2–4 fluid ounces) of the beverage, and is suitably constructed of a durable, disposable, safe, white, plastic designed to hold food products, is and designed not to leak, and to provide the contained food items with a substantial shelf life and without the need for refrigeration.

A first closure element (lid) extends across (covers) the cup opening and is designed for easy peel-off removal, so as to expose the beverage contained within the cup for consumption. The lid is suitably white, with the customer option of having their church or organization name printed on it.

A second closure element is disposed on the sidewall of the cup, and may be in the form of a cross. A tab permits a user to at least partially remove the second closure element, thereby exposing a food item disposed within a recess in the sidewall of the cup. The second closure element is constructed of a durable, safe, sanitary plastic. The second closure element is preferably not entirely removed, thereby allowing for (ensuring) disposal of one unit, not parts thereof.

According to an aspect of the invention, the second closure element bears an inscription, such as "This Do In Remembrance of Me".

The Communion Container of the present invention eliminates the need for an individual to manually-prepare the Communion sacramental food items for mass distribution, and ensures that each the sacramental food items are fit for consumption and sanitary. The Communion Container is readily filled by use of machinery, avoiding spills of the beverage and food product and waste thereof.

The design of the Communion Container of the present invention also prevents harmful elements from penetrating the surface to the inside of the food product. The Communion Container may be designed with ridges in a horizontal (circumferential) direction to allow easy holding, handling, serving and placement in the standard communion tray or on a flat serving tray.

The bottom of the Communion Container can bear the name, address and telephone number of the distributor of the product as well as the expiration date for the liquid beverage and the bread/wafer/cracker.

The Communion Container is designed for use in connection with administering sacramental elements during communion, church service, retreats, visitation, and serving sick and shut in, camping, retreats, inside or outside a worship facility, and the like.

The Communion Container is not designed for reuse. Instead, it is designed and intended to be a disposable single-serving container.

The cup of the Communion Container is formed of for example, of thermoplastic, polystyrene or polyethylene. The first closure element sealing a first food item within the cup is formed of a gas and moisture impervious closure membrane sheet which is heat-sealed or vacuum-sealed to the top surface of the cup lip. The first closure element is typically a membrane of thermoplastic, thermoplastic coated paper, paper-backed foil or plain foil treated with heat activated adhesive. The use of such an adhesive, however is less than desirable in that it tends to leave objectionable deposits on the cup lip. The second closure element may be formed of the same material as the first closure element.

An advantage of the Communion Container of the present invention is that it may be quickly and easily refrigerated if the consumer prefers the beverage cold. However, refrigeration is not required for this product. Another advantage of the invention is that the Communion Container is easily disposable and, due to the small portions involved, there will be no need to reuse any individual serving.

BRIEF DESCRIPTION OF THE DRAWINGS

The structure, operation, and advantages of the presently preferred embodiment of the invention will become further apparent upon consideration of the following description taken in conjunction with the accompanying drawings, wherein.

DETAILED DESCRIPTION OF THE INVENTION

Figure 1A:
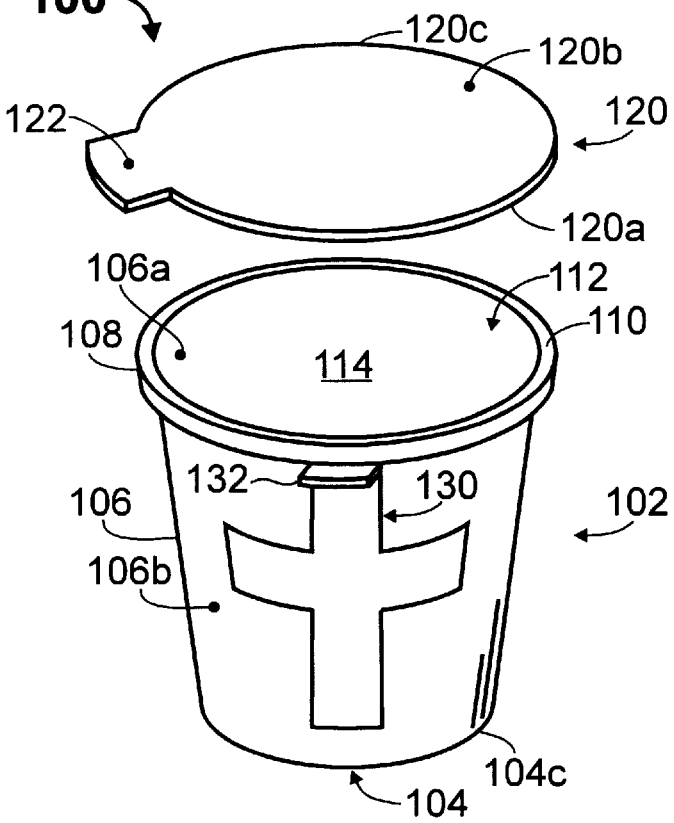
FIG. 1A is a front, exploded, perspective view of an embodiment of a Communion Container, according to the invention.
Figure 1B:
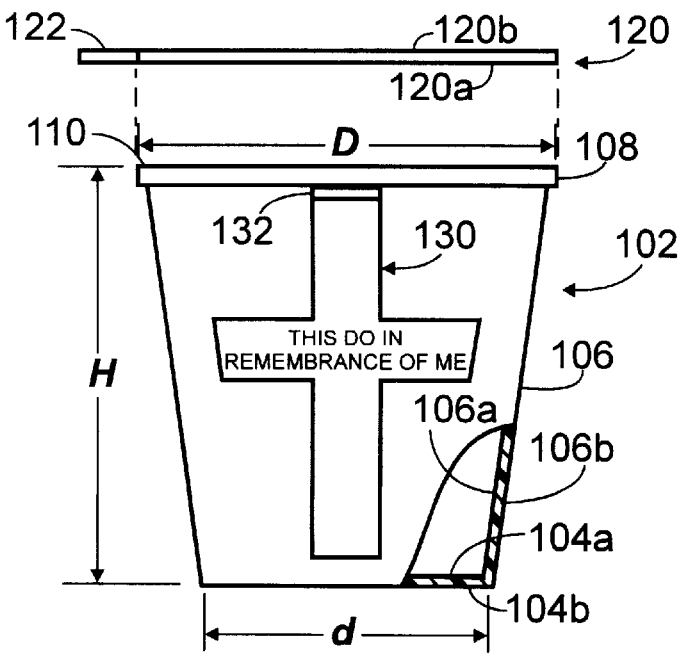
FIG. 1B is a front, exploded, elevational view of the Communion Container of FIG. 1, according to the invention.

FIGS. 1A and 1B illustrate, in perspective and front views, respectively, an embodiment of the Communion Container 100 of the present invention. The Communion Container 100 comprises a cup portion (element) 102 and a first closure element (lid) 120.

The cup 102 has a base 104 which is generally in the form of a planar disc. The base 104 has an inner surface 104*a* and an outer surface 104*b* and a periphery 104*c*. The base 104 may be in the form of a flat disc, having a diameter "d", and a thickness between its inner and outer surfaces 104*a* and 104*b*.

A sidewall 106 extends upward, a distance "H" from the periphery 104*c* of the base 104, and terminates in an annular lip 108. The annular lip 108 is preferably parallel to the base 104. The sidewall 106 has an inner surface 106*a* and an outer surface 106*b*, and a thickness therebetween. The thickness of the sidewall 106 is suitable substantially equal to the thickness of the base 104.

The annular lip 108 is suitably slightly thicker than the thickness of the sidewall 106. A top edge 110 of the annular lip 108 constitutes the top edge of the cup 102 and forms an opening 112 into which fluid can be put into (filled) and taken out of (drank from) the cup 102. The annular lip 108 has a diameter "D", and the diameter (not labeled in the figure) of the opening 112 is only somewhat smaller (being smaller than the diameter of the annular lip 108 by an amount equal to the thickness of the annular lip 108).

Preferably, the base 104, sidewall 106 and annular lip 108 are formed as a unitary structure which is constructed of a durable, disposable, safe, plastic designed to hold food products and designed not to leak, with a substantial shelf life and without the need for refrigeration. The cup is preferably colored white.

Suitable dimensions for the cup 102 are as follows:

the diameter "d" of the base 104 is in the range of 1–4 inches;

the height "H" of the cup 102 is in the range of 2–6 inches;

the diameter "D" of the annular lip 108 is in the range of 2–5 inches; and the thickness(es) of the base 104 and the sidewall 106 is (are) in the range of 0.005–0.025 inches.

The cup 102 is intended to contain a liquid (beverage), is sized to hold an individual portion (e.g., 1–10 fluid ounces, preferably 2–4 fluid ounces) of the beverage.

The first closure element (lid) 120 is generally in the form of a planar disc. The lid 120 has an inner surface 120*a*, an outer surface 120*b* and a periphery 120*c*. The lid 120 has a diameter which is at least "D", preferably substantially equal to "D", and a thickness between its inner and outer surfaces 120*a* and 120*b*.

The lid 120 is disposed across the opening 112 (i.e., across the top edge 110 of the lip 108). Thereby, a first compartment 114 is defined by the inner surface 104*a* of the base 104, the inner surface 106*a* of the sidewall 106 and the inner surface 120*a* of the lie 120. A first food item (not shown), such as a liquid, is contained within the first compartment 114, within the cup 102, until such time as the lid 120 is removed.

The first food item may thus be packaged for distribution within the first compartment 114 of the container 100. subsequently, when the lid 120 is at least partially removed, the first food item contained within the first compartment 114 can by dispensed for consumption.

To facilitate a user removing the lid 120, the lid 120 is provided with a tab 122 projecting from the periphery of the lid 120 and extending beyond the periphery of the annular lip 108. In use, the user grasps the tab 122 and peels-off the lid 120 so as to expose the beverage (not shown) contained within the interior of the cup 102 for consumption. The lid 120 is suitably white, with the customer option of having a legend, such as the name of their church or organization name printed or embossed on it.

Suitable dimensions for the lid 120 are as follows:

a diameter "D" in the range of about 1.5 inches to 6 inches; and a thickness in the range of about 0.025 inches or less.

FIGS. 1A and 1B also illustrate a second closure element 130 disposed on the outer surface 106*b* of the cup sidewall 106. As explained in greater detail hereinbelow, this second closure element 130 conceals a second, non-liquid (solid) communion food element (not shown) such as a wafer, a cracker or a piece of bread, or the like. The second closure element 130 is provided with a tab 132, or the like, extending from its periphery, for at least partially removing the second closure element 130 from the outer surface 106*b* of the cup sidewall 106 so as to reveal the concealed second communion food item, thereby permitting a user to grasp the second communion food item and ingest it. As best viewed in FIG. 1B, the second closure element 130 may be imprinted (or embossed) with a legend, such as "THIS DO IN REMEMBRANCE OF ME".

Figure 2A:
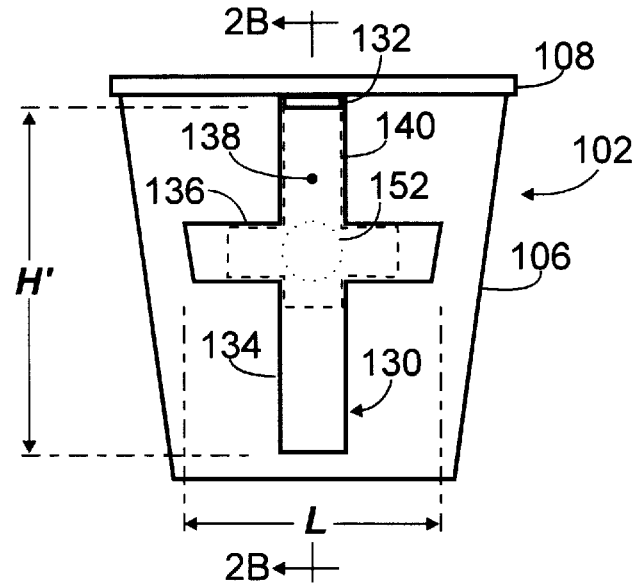
FIG. 2A is a front elevational (plan) view of an embodiment of the cup element of the Communion Container of FIG. 1, according to the invention.
Figure 2B:
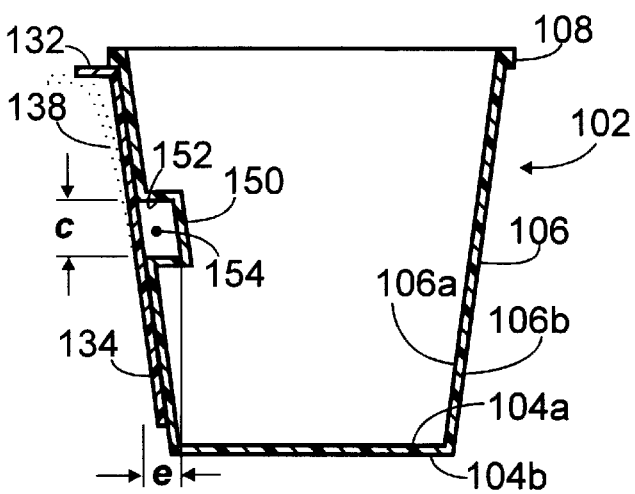
FIG. 2B is a cross-sectional view of the cup element of the Communion Container of FIG. 2A, the view being taken on a line 2B—2B, according to the invention.

FIGS. 2A and 2B illustrate in front plan and cros-sectional views, respectively, an embodiment of the cup 102 of the Communion Container 100 of the present invention. In these figures, the first closure element (lid) 120 is not shown, for illustrative clarity.

As best viewed in FIG. 2B, a portion 150 of the sidewall 106 of the cup 102 extends inwardly, towards the interior of the cup 102, to form a recess which is sized and shaped to receive the second communion element (not shown). The recess has an opening 152 at the outer surface 106*b* of the sidewall 106 and the portion 150 of the sidewall extends from the opening 152 towards the interior of the cup 102. The second closure element 130 extends across the opening 152, completely covering the recess 150, thereby causing the second communion element to be completely contained within the recess 150. In this manner, a second compartment 154 is formed in the container 100.

The second food item may thus be packaged for distribution within the second compartment 154 of the container 100. Subsequently, when the closure element 130 is at least partially removed, the second food item contained within the second compartment 154 can by dispensed for consumption.

By way of example, the recess 150 may be formed as a cylindrical depression in the sidewall 106 of the cup 102, having a cross-dimension (circumference) "c" which is a fraction of the overall height "H" of the cup 102, and extending to a depth "e" which is a fraction of the cup diameter (either "d" or "D") into the interior of the cup 102. The sidewall 106, being formed of a material which is impervious to liquid, isolates the recess 150 from the interior of the cup 102, thereby isolating the first communion element from the second communion element and preventing them from coming into contact with one another. It is clearly contemplated that the recess 150 can be shaped other than as a cylindrical depression.

The second closure element 130 extends across the outer surface 106*b* of the cup 102 and is larger than the opening of the recess 150 so that it completely covers the recess 150, thereby causing the second communion element to be completely contained within the recess 150.

Figure 2C:
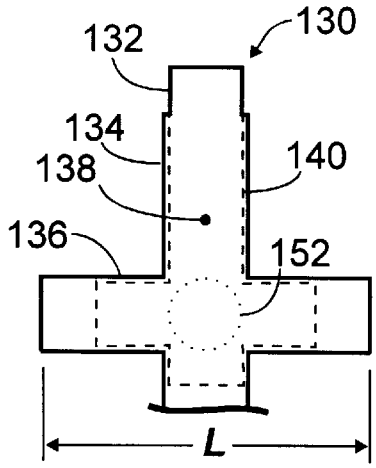
FIG. 2C is an enlarged, partial, plan view of an embodiment of a closure element for the cup element of the Communion Container of FIG. 2A, according to the invention.

FIGS. 2A and 2C illustrate an exemplary embodiment of the second closure element 130 which is in the form of a cross having an upright (vertical) portion 134 and a transverse (horizontal) portion 136 intersecting the upright portion 134. The transverse portion 136 is preferably bisected by the upright portion 134. The upright portion 134 is parallel to the axis of the cup 102, and has a height "H" which is somewhat less than the overall height "H" of the cup 102. The transverse portion 136 extends partially circumferentially around the sidewall 106 of the cup 102, for example, approximately one-quarter of the way around the cup. Therefore, the length "L" of the transverse portion 136 would be approximately $\frac{1}{4} * \pi ((d+D)/2)/2)^2$.

As mentioned hereinabove, the second closure element 130 is provided with a tab 132, or the like, for at least partially removing the second closure element 130 from the outer surface 106*b* of the cup sidewall 106 so as to reveal the concealed second communion food item, thereby permitting a user to grasp the second communion food item and ingest it. In FIG. 2C the tab 132 is shown extending upward from (in line with) the upright portion 134 of the closure element 130.

It is generally preferred that the second closure element 130 is constructed and affixed to the sidewall 106 of the cup 102 so that it may conveniently be only partially be peeled back, sufficient to reveal the second communion element disposed within the recess 150. In this manner, the user need not be concerned with (or distracted by) holding onto (i.e., juggling) a second closure element which otherwise would fully removed from the cup 102 pending its disposal.

To this end, as best viewed in FIG. 2C, an area 138 of the second closure element 130 which extends contiguously from the tab 132 and encompasses (is directly over) the recess 150 is provided with a pattern of perforations 140 (or weakening lines) which commence at the tab 132, continue along to "outline" the area 138 of the closure element 130, and terminate at the tab 132. In other words, the weakening line 140 defines the area 138 of the second closure element 130 which covers an area on the outer surface 106*b* of the sidewall which includes and encompasses the opening 154.

In this manner, when the user pulls on the tab 132, the entire area 138 will peel away from the remainder of the closure element 132, revealing the second communion element which is contained within the recess 150. Reference is made to FIG. 2B which shows, in dashed lines, that the tab 132 has been pulled, causing the area 138 to lift off from the outer surface 106*b* of the cup sidewall 106, while the remaining area of the closure element remains attached to the cup sidewall 106.

As described in greater detail hereinbelow, with respect to FIG. 3B, it is preferred that the removable portion 138 of the second closure element 130 be only partially removed, yet sufficiently removed to allow the user to gain access to the food item contained within the second compartment 154. For example, the weakening line 140 may only partially circumscribe the area 138, so that a portion of the area 138 remains hingedly attached to the remaining portion of the second closure element 130.

Returning to FIG. 1A, each of the first and second closure tabs 122 and 132, respectively, has an angular position with respect to the lip 108 of the cup 102. For a lip 108 which is circular, these angular positions can be expressed as "circumferential" positions. It is apparent (as shown) that the first closure tab 122 may be aligned at a different circumferential position (offset from) than the second closure tab 132. Alternatively (not shown), the first closure tab 122 may be aligned at a circumferential position which is substantially coincident with the circumferential position of the second closure tab 132.

An Alternate Embodiment

Figure 3A:
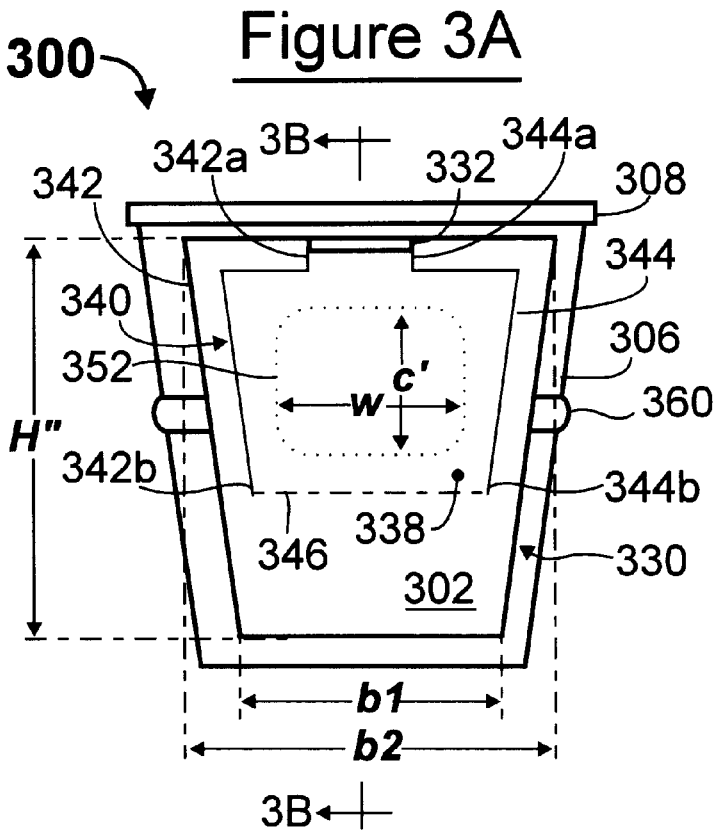
FIG. 3A is a front elevational (plan) view of an alternate embodiment of the cup element of the Communion Container of the present invention.
Figure 3B:
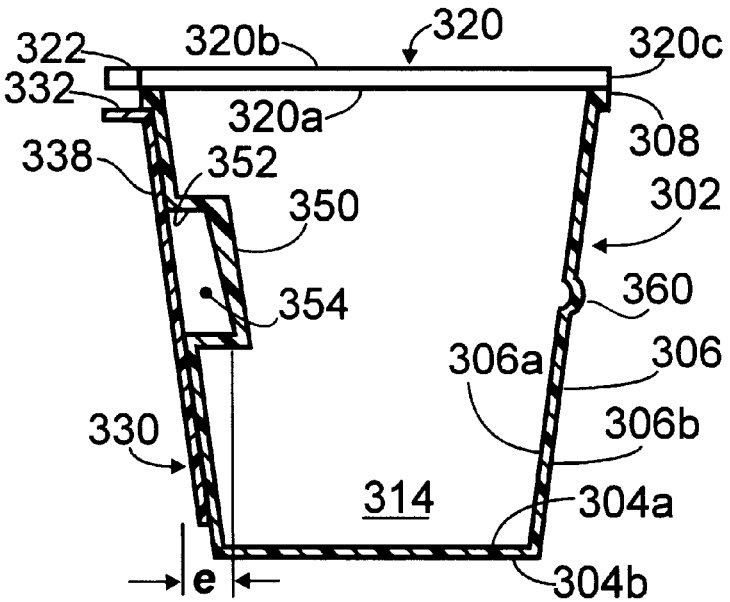
FIG. 3B is a cross-sectional view of the cup element of the Communion Container of FIG. 3A, the view being taken on a line 3B—3B, according to the invention.

FIGS. 3A and 3B, comparable to FIGS. 2A and 2B, illustrate an alternate embodiment of a Communion Container 300 (compare 100) of the present invention. The principal differences 20 between this embodiment (300) and the embodiment (100) described hereinabove is that an opening 352 (compare 152) of the recess formed in the area 354 of the sidewall 306 (compare 106) for receiving the second (solid) communion food item is larger. Therefore, for a given depth "e", the second compartment 354 (compare 154) is larger. Consequently, the second closure element 330 (compare 130), particularly the portion 338 (compare 138) defined by the weakening line(s) 340 (compare 140) is larger so as to cover the larger opening 352 and securely retain the second communion element within the second compartment 354, pending its removal and consumption.

Other than with respect to the size of the second compartment 354, the cup 302 is similar in size, construction and materials to the previously described cup 102. Namely, the cup has a base 304 (compare 104) having an inner surface 304*a* (compare 104*a*), an outer surface 304*b* (compare 104*b*) and a periphery 304*c* (compare 104*c*), and has a sidewall 306 (compare 106) extending from the periphery 304*c* of the base 304 to an annular lip 308 (compare 108) having a top edge 310 (compare 110). The sidewall 306 has an inner surface 306*a* (compare 106*a*) and an outer surface 306*b* (compare 102*b*). As best viewed in FIG. 3B, a first closure element (lid) 320 (compare 120) has an inner surface 320*a* (compare 120*a*), an outer surface 320*b* (compare 120*b*), a periphery 320*c* (compare 120*c*) and a tab 322 (compare 122) extending from the periphery 320*c* of the lid 320. The lie 320 is omitted from the view of FIG. 3A for illustrative clarity. A first compartment 314 (compare 114) is defined by the inner surface 304*a* of the base 304, the inner surface 306*a* of the sidewall 306, and the inner surface 320*a* of the lid 320. In a manner similar to the Communion Container 100 described hereinabove, in this embodiment of a Communion Container 300, a second compartment 354 (compare 154) is defined by the recess 350 and a portion of the inner surface of the second closure element 330.

As best viewed in FIG. 3B, the second compartment 354 has a first, vertical dimension "c'", which is a fraction of the overall height ("H") of the cup 302, and the recess 350 extends to a depth "e" which is a fraction of the cup diameter (either "d" or "D") into the interior of the cup 302. As best viewed in FIG. 3A, the opening 352 has a second cross-dimension "w" which is a fraction of the circumference of the sidewall 306 of the cup 302.

A side-by-side comparison of FIGS. 1A and 1B and FIGS. 1B and 3B, respectively, makes it clear that the opening 352 in the sidewall 306 of the cup 302 is larger than the opening 152 in the sidewall 106 of the cup 102. Thus, a larger second food item (not shown) can be packaged in and subsequently dispensed from the second compartment 354.

With regard to the second closure element 330, it is also readily apparent that the second closure element 330 of the Communion Container 300 is larger than the second closure element 130 of the Communion Container 100. More particularly, the second closure element 330 is suitably in the form of a trapezoid, having a height "H"" which may be comparable to the height "H'" of the second closure element 130, and having two base dimensions "b1" and "b2" which are comparable to the overall width "L" of the second closure element 130.

As in the previous embodiment (100), in this embodiment of a Communion Container 300, a weakening line 340 (compare 140), such as perforations, defines an area 338 (compare 138) of the second closure element 330 which encompasses and completely covers the opening 352, and which preferably extends from the tab 332 (compare 132). In this manner, pulling on the tab 332 will cause a selected portion 338 of the second closure element 330 to peel off, while remaining connected to the remainder of the second closure element, without causing removal of the entire second closure element 330, thereby alleviating any necessity for the user to dispose of either the second closure element 330 or the selected portion 338 thereof.

The second closure element 330 is suitably colored to blend in with the color of the cup 302, or may be transparent, and may be imprinted with a design (e.g., a cross) cross and a legend so as to visually resemble the cross/legend closure element 130 illustrated in FIG. 1B.

As best viewed in FIG. 3A, in this embodiment of the Communion Container 300, the portion 338 of the second closure element 330 is only partially circumscribed by the weakening line 340. In other words, a first weakening line 342 has a proximal end 342*a* at the tab 332 and extends partially around a one side of the area 338, and a second weakening line 344 has a proximal end 344*a* at the tab 332 and extends partially around another side of the area 338. The distal ends 342*b* and 344*b* of the weakening lines 342 and 344, respectively, do not meet, but rather are spaced apart from one another. In this manner, when the user pulls the tab 332 and causes the area 338 to peel off of the outer surface 306*b* of the sidewall 306 sufficiently to permit the user to retrieve a stored food item (not shown) from the second compartment 354. The peeled area 338 will remain hingedly attached (along the dashed line 346) to the remaining portion of the second closure element 330 which remains affixed to the outer surface 306*b* of the sidewall 306, thereby facilitating disposal (after use) of the Communion Container and its components.

As mentioned above, the Communion Container may be designed with ridges in a horizontal (circumferential) direction to allow easy holding, handling, serving and placement in the standard communion tray or on a flat serving tray. As illustrated in FIGS. 3A and 3B, the cup 302 is shown with one raised ridge 360 extending circumferentially around the outer surface 306*b* of the sidewall 306. This ridge 360 is representative of a plurality of such ridges that could extend circumferentially, parallel to one another, around the outer surface 306*b* of the sidewall 306 of the cup 306.

While the invention has been described in combination with embodiments thereof, it is evident that many alternatives, modifications, and variations will be apparent to those skilled in the art in light of the foregoing description. Accordingly, the invention is intended to embrace all such alternatives, modifications and variations as fall within the spirit and broad scope of the appended claims.

What is claimed is:

1. A container, comprising:

a cup having a base, a lip, and a sidewall extending from a periphery of the base to the lip;

a first peel-off closure element adapted to fit across the lip, thereby forming a first compartment defined by an inner surface of the base, an inner surface of the sidewall, and an inner surface of the first peel-off closure element;

a recess in the sidewall of the cup, said recess having an opening at an outer surface of the sidewall, said recess extending from the opening towards the interior of the cup; and a second peel-off closure element disposed on the outer surface of the sidewall and extending across the opening of the recess, thereby forming a second compartment defined by an inner surface of the second peel-off closure element and the outer surface of the sidewall.

2. A container, according to claim 1, further comprising:

a first tab extending from the periphery of the first peel-off closure element.

3. A container, according to claim 1, further comprising:

a second tab extending from a periphery of the second peel-off closure element.

4. A container comprising:

a cup having a base, a lip, and a sidewall extending from a periphery of the base to the lip;

a first peel-off closure element adapted to fit across the lip, thereby forming a first compartment defined by an inner surface of the base, an inner surface of the sidewall, and an inner surface of the first peel-off closure element;

characterized by:

a recess in the sidewall of the cup, said recess having an opening at an outer surface of the sidewall, said recess extending from the opening towards the interior of the cup; and a second peel-off closure element disposed on an outer surface of the sidewall and extending across the opening of the recess, thereby forming a second compartment defined by an inner surface of the second peel-off closure element and the outer surface of the sidewall; and further comprising:

a first tab extending from the periphery of the first peel-off closure element at a first angular position with respect to the lip; and a second tab extending from a periphery of the second peel-off closure element at a second angular position with respect to the lip.

5. A container, according to claim 4, wherein:

the first and second angular positions are coincident with one another.

6. A container, according to claim 4, wherein:

the first and second angular positions are offset from one another.

7. A container comprising:

a cup having a base, a lip, and a sidewall extending from a periphery of the base to the lip;

a first peel-off closure element adapted to fit across the lip, thereby forming a first compartment defined by an inner surface of the base, an inner surface of the sidewall, and an inner surface of the first peel-off closure element;

characterized by:

a recess in the sidewall of the cup, said recess having an opening at the outer surface of the sidewall, said recess extending from the opening towards the interior of the cup; and a second peel-off closure element disposed on an outer surface of the sidewall and extending across the opening of the recess, thereby forming a second compartment defined by an inner surface of the second peel-off closure element and the outer surface of the sidewall; and further comprising:

a weakening line disposed on the second peel-off closure element and defining an area of the second peel-off closure element which is aligned directly over the opening of the recess.

8. A container comprising:

a cup having a base, a lip, and a sidewall extending from a periphery of the base to the lip;

a first peel-off closure element adapted to fit across the lip, thereby forming a first compartment defined by an inner surface of the base, an inner surface of the sidewall, and an inner surface of the first peel-off closure element;

characterized by:

a recess in the sidewall of the cup, said recess having an opening at the outer surface of the sidewall, said recess extending from the opening towards the interior of the cup; and a second peel-off closure element disposed on an outer surface of the sidewall and extending across the opening of the recess, thereby forming a second compartment defined by an inner surface of the second peel-off closure element and the outer surface of the sidewall; and further comprising:

a tab extending from a periphery of the second peel-off closure element; and a weakening line disposed on the second peel-off closure element, extending contiguously from the tab, and defining an area of the second peel-off closure element which is aligned directly over the opening of the recess.

9. A container, according to claim 1, wherein:

the cup is sized to hold 1–10 fluid ounces of a liquid.

10. A container, according to claim 1, wherein:

the cup is sized to hold 2–4 fluid ounces of a liquid.

11. A container, according to claim 1, wherein:

the lip has a diameter "D" in the range of 1.5–6 inches;

the base has a diameter "d" in the range of 1–4 inches; and the cup has a height "H" in the range of 2–6 inches.

12. A container, according to claim 1, wherein:

the cup is formed of a material selected from the group consisting of thermoplastic, polystyrene and polyethylene.

13. A container, according to claim 1, wherein:

the first peel-off closure element is formed as a membrane of a material selected from the group consisting of thermoplastic, thermoplastic coated paper, paper-backed foil and plain foil, said membrane treated with heat activated adhesive.

14. A container, according to claim 1, wherein:

the second peel-off closure element is formed as a membrane of a material selected from the group consisting of thermoplastic, thermoplastic coated paper, paper-backed foil and plain foil, said membrane treated with heat activated adhesive.

15. A container, according to claim 1, wherein:

a first communion element is disposed in the first compartment; and a second communion element is disposed in the second compartment.

16. A container, according to claim 15, wherein:

the first communion element is a liquid selected from the group consisting of water, wine and juice.

17. A container, according to claim 15, wherein:

the second communion element is a solid selected from the group consisting of bread, wafer and cracker.

* * * * *